United States Patent [19]

Siegel

[11] 4,263,951

[45] Apr. 28, 1981

[54] INTERCHANGEABLE ACCESSORY SYSTEM FOR HANDBAGS

[75] Inventor: Milton I. Siegel, Tempe, Ariz.

[73] Assignee: AMBA Marketing Systems, Inc., Tempe, Ariz.

[21] Appl. No.: 49,739

[22] Filed: Jun. 18, 1979

[51] Int. Cl.[3] ..... A45C 3/06

[52] U.S. Cl. ..... 150/35; 150/34

[58] Field of Search ..... 150/34, 35, 28 R, 28 A

[56] References Cited

U.S. PATENT DOCUMENTS

| | | | |
|---|---|---|---|
| 2,477,388 | 7/1949 | Moore | 150/34 |
| 2,675,042 | 4/1954 | Herrera | 150/34 |
| 3,326,258 | 6/1967 | Stucker | 150/34 |
| 3,347,299 | 10/1967 | Alexander | 150/34 |
| 3,414,033 | 12/1968 | Tucker | 150/34 |
| 3,415,300 | 12/1968 | Worcester | 150/34 X |

FOREIGN PATENT DOCUMENTS

| | | | |
|---|---|---|---|
| 2752944 | 12/1978 | Fed. Rep. of Germany | 150/34 |

*Primary Examiner*—Donald F. Norton

*Attorney, Agent, or Firm*—Gregory J. Nelson

[57] ABSTRACT

The disclosure relates to an organizer handbag system having multiple handbags in the system and interchangeable components and accessories. The interchangeable components and accessories may include a wallet, cosmetic case, key ring, address and note books and selected components are provided with attachment means so that the interchangeable accessories can be conveniently transferred from one handbag to another and secured therein at cooperable attachment means. Other of the accessory items are interchangeably positionable in pockets in the handbags. The accessories are selected in design and appearance to be compatible with a wide variety of handbag styles.

2 Claims, 8 Drawing Figures

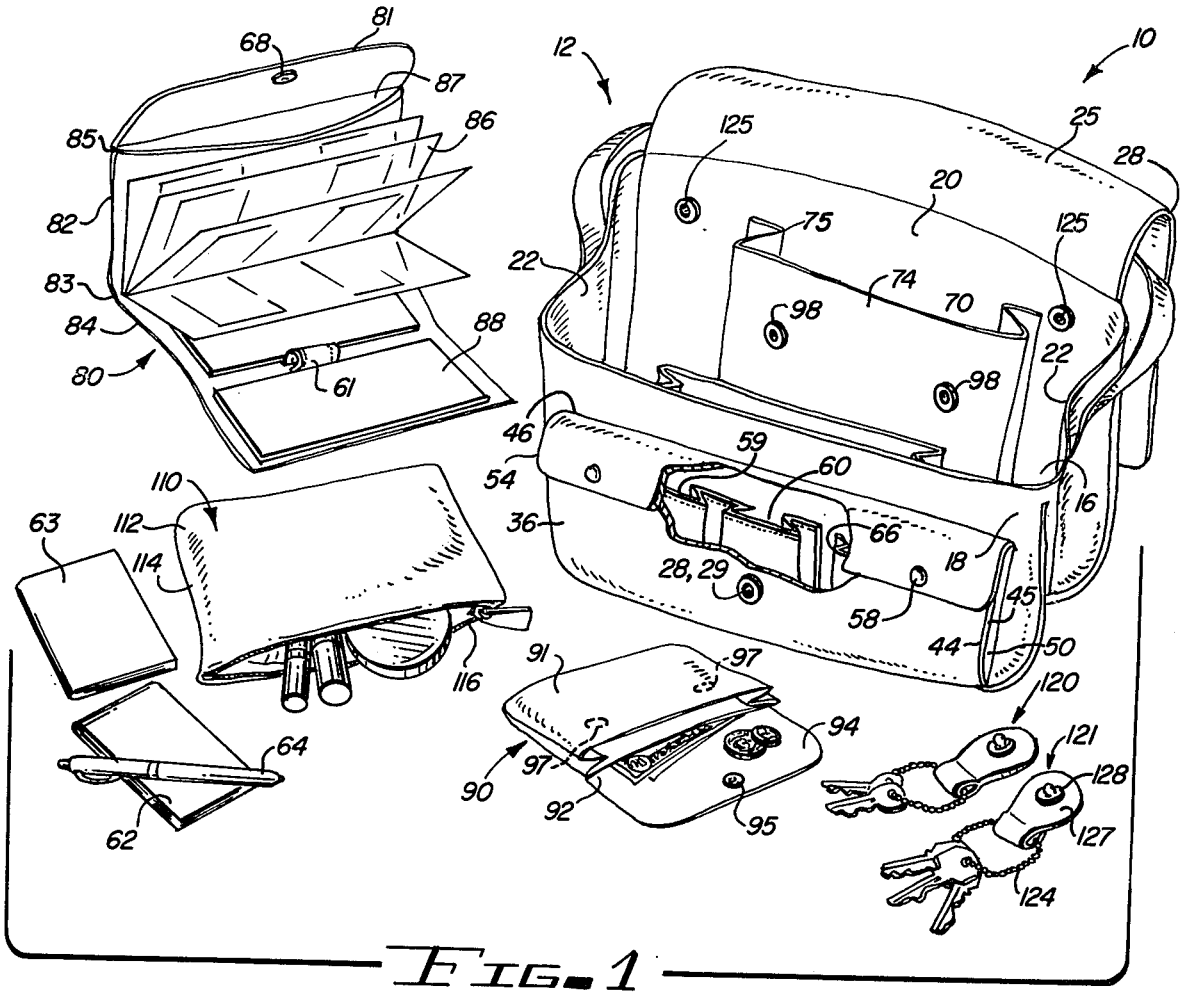
FIG. 1
FIG. 2
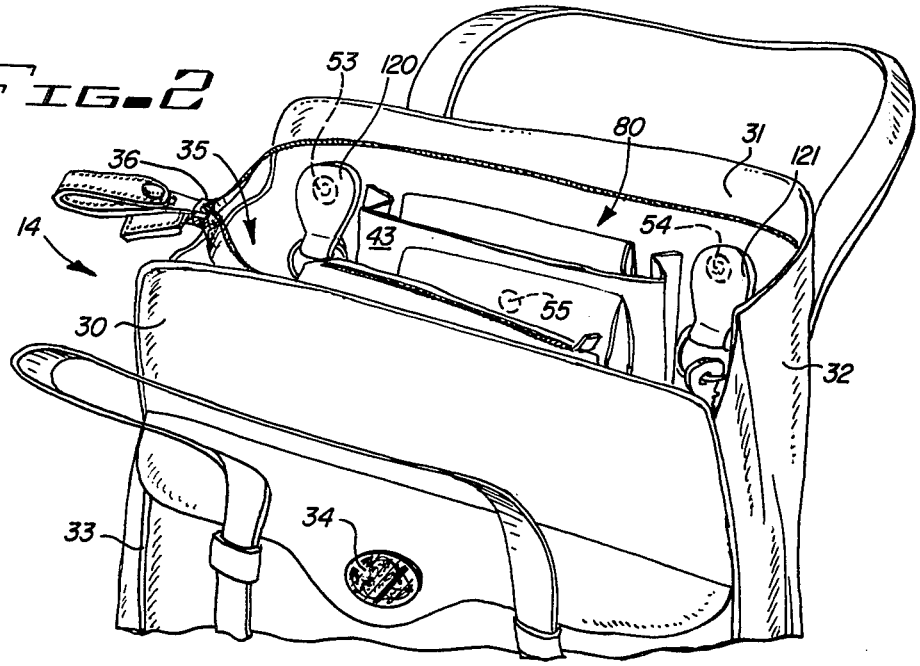

INTERCHANGEABLE ACCESSORY SYSTEM FOR HANDBAGS

This invention relates to handbags. More particularly, the present invention concerns an interchangeable accessory system for handbags in which various accessories for the organized arrangement and containment of personal affects may be utilized with various handbags.

The use of handbags for containment of various personal items is a well-established tradition. Most women consider a handbag or purse as a necessity to support their daily activities. A handbag is used to contain a variety of items, typically such as credit cards, photographs, credentials, glasses, checkbook, wallet, change purse, keys, stamps, note paper, phone number listings, tissues and the like. To accomodate these various items, handbag manufacturers have provided handbags including specialized compartments, wallets, cases and purses for the orderly reception of these items. For example, it is known to provide a handbag or purse with compartments and pockets for the reception of credentials, credit cards, cosmetics and similar sundry items. Often the user carries a wallet which is placed in one of the compartments of the handbag along with other items such as residence and automotive keys. These items often become entangled at the bottom of the purse compartment making it difficult for the user to retrieve a particular item.

Numerous styles and designs of handbags are available to satisfy the individual aesthetic preference of the user and compliment a particular garment or occasion. Most women own several handbags frequently changing from one to another to match the style with the occasion or a color of a particular dress or article of apparel. When this is done, it is necessary for the user to remove the needed contents from one handbag and then transfer the contents to another. As pointed out above, this can be difficult as many items have been simply placed loosely within the handbag and it is necessary to sort through the items in the handbag and make the transfer so that the selected new handbag contains the necessary items. Transferring of items from one handbag to another is not efficient and often items are forgotten or left in a previous handbag which are needed later.

Accordingly, it is an object of the present invention to provide a handbag system to sustain everyday activities which provides for the convenient and expedient interchangeability of certain common accessories from one handbag to the other. Briefly, to achieve the objects of the present invention and in accordance with the preferred embodiment of the invention, a ladies handbag system is provided having a plurality of organizer handbags in different styles each arranged for the orderly reception of various accessory items such as a wallet, cosmetic case, coin purse, notebooks and key chains. The accessory items are configured to be removable from one handbag and interchangeable in another handbag style to provide the organizer features. The accessories are aesthetically compatible with the various handbags.

In an alternate embodiment of the present invention, the various accessories are detachably securable, as by snaps or loop and pile fastener material, to the liner which is removable from one handbag and insertable in another handbag.

The foregoing and further and more specific objects and advantages of the present invention will become readily apparent to those skilled in the art from the following detailed description taken in conjunction with the drawings in which:

FIG. 1 is a perspective view of the handbag system of the present invention illustrating a handbag and the various interchangeable accessories;

FIG. 2 is a partial perspective view of another handbag system with the accessories in place in the handbag;

Figure 3:
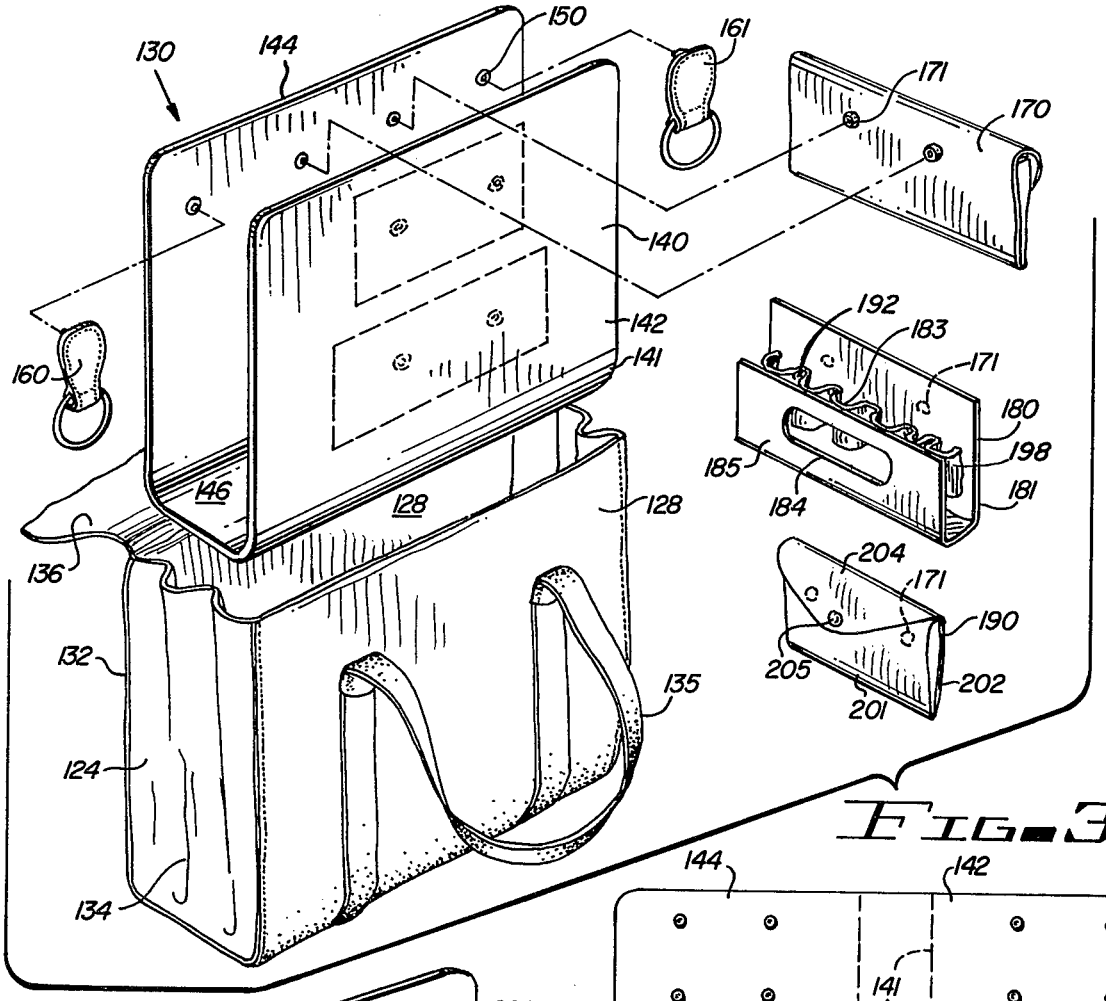
FIG. 3 is an exploded perspective view of an alternate embodiment of the handbag system of the present invention in which an interchangeable liner is utilized.

Throughout the specification the terms "front" and "rear" and "interior" and "exterior" are used to establish a frame of reference for description of the handbag. These terms are not to be construed in a limiting sense. Similarly, the terms "handbag", "bag" and "purse" are used interchangeably throughout the specification.

Turning now to the drawings in which the same reference numerals indicate corresponding elements throughout the several views, attention is directed to FIGS. 1, 2, 7 and 8 which illustrate the preferred embodiment of a handbag system of the present invention generally designated by the numeral 10. The handbag system 10 of the present invention includes a handbag 12. Handbag 12 has a central compartment 16 formed between front panel 18, rear panel 20 and opposite end panels 22, which may be suitably lined with a material of appropriate design and color. Handbag 12 may be fabricated from various materials such as leather or vinyl, either sewn, heat bonded or otherwise assembled in accordance with established techniques of the art.

A flap 25 is hingedly affixed at 28 along the upper edge of the rear panel 20 and in the closed position lies in juxtaposition with the front panel 18. A snap fastener member is carried on the inner side of flap 25 and a cooperative snap fastener member 29 is secured near the lower edge of front panel 18.

A generally rectangular pouch 36, useful for carrying letters, receipts and corresponding similar documents, is carried on the front panel 18. Pouch 36 is formed by a front panel 44 secured to the vertical edges of front panel 18 by pleated expandable members 45. Rear panel 50 is stitched or otherwise affixed at opposite edges to pleated end members 45 so that an insert pocket 46 is defined between the front panel 18 and rear panel 50. Flap 54 is an extension of panel 50 and forms a closure member for pouch 36 and carries an appropriate fastener members 58 which matingly engage snap fastener members carried at the upper edge of pouch panel 44.

Pockets 59 and 60 are provided within pouch 46 for reception of notebooks and address books 62 and 63. Smaller pocket 66 is adjacent pocket 60 for insertion of a pen, pencil or other writing instrument 64.

Storage means in the form of a pocket 70 is formed in compartment 16 at the interior side of rear panel 20 by panel 74. Panel 74 is stitched to panel 20 at vertical stitich lines along opposite edges. Panel 74 is pleated in accordian folds 75 to allow for expandability of the pocket 74. Pocket 74 is sized and configured to accomodate an accessory item such as wallet 80. Wallet 80 has a top, intermediate and bottom cover 81, 82 and 84, respectively, joined at medial fold lines 83 and 85 forming a tri-fold arrangement. Wallet 80 contains a series of pages or leaves 86 each defining one or more transparent pockets for receiving credit cards, photos and other items. These leaves are, for example, the type more fully described in U.S. Pat. No. 3,759,305 entitled "Card Carrying Case" issued to Donald E. McIntyre. Wallet 80 also defines a pocket 87 for reception of other items such as currency. A conventional checkbook 88 may be inserted at flap 89 in panel 84. Closure snap fastening means 68 are secured to the top and bottom panels for securing the wallet in a closed position. Loop 61 is for retention of a pen or other writing instrument.

A coin purse 90 is detachably secured to the front of pocket 70. Purse 90 is primarily for receipt of coins and currency and has front and back panels 91 and 92, respectively. Closure flap 94, which is an extension of rear panel 92, is adapted to overlap a portion of the front panel 91 in a closed position and be engaged at fastener 95. A pair of male snap fasteners 97 are secured to the rear panel 92 of the purse. Mating fastener members 98 are secured to panel 74. Thus, pocketbook 90 can be engaged within the handbag compartment and currency and coins removed and inserted in this position. It is also convenient for the user to disengage pocketbook 90 at snap members 97 and 98 to permit transfer of the pocketbook to another handbag. The detachability of the pocketbook provides security as money may be removed from the purse for safekeeping in the event the entire handbag is stored or left unattended.

A pouch 110 having opposite side panels 112 and 114 is stitiched along exterior edges and is insertable in the main compartment of the handbag. Pouch 112 is closeable by conventional zipper 116 extending along the upper edge of the pouch. The zipper case is primarily for reception of cosmetic and makeup items such as lipstick and polishes, manicure items and the like.

Key retainer members 120 and 121 are disposed at either side of the pocketbook. Since the key retainers are basically identical, a detailed description of one of the retainers is sufficient. Retainer 120 has a body 127 and a snap fastener half 128 located on the body. Key holder means 124 is in the form of a bead chain or coil loop as is well-known in the art. Mating snap fastener halves 125 are secured to the interior of panel 20 disposed at either side of pocket 70. With the key retainers 120 and 121 engaged to the panel 20, the keys on each retainer are readily available and are stored within the security of compartment 16. Keys may be retrieved for use without the necessity of rummaging through the purse compartment as is often necessary when keys are carried as loose items in the pocket or purse. Inclusion of multiple key retainers 120 and 121 permits the user to maintain automobile and residence keys on separate retainers. This facilitates locating a particular key and it is not necessary for the user to manually separate an automobile key from the key holder 129 when the vehicle is loaned to another individual.

Other organizer pockets and compartments may be provided as is well-known in the art. Organizer purses of the general type are disclosed in U.S. Pat. No. 3,955,609 issued May 11, 1976 to the applicant.

Figure 7:
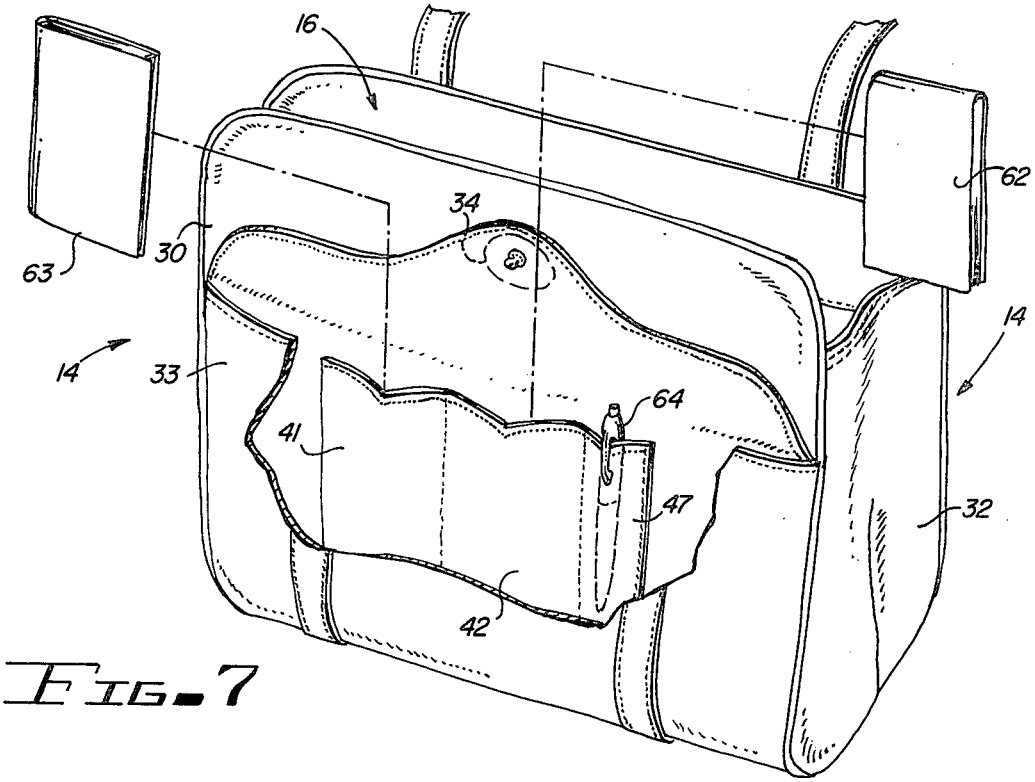
FIG. 7 is a front perspective view of the handbag shown in FIG. 2 with the exterior pocket partly broken away.
Figure 8:
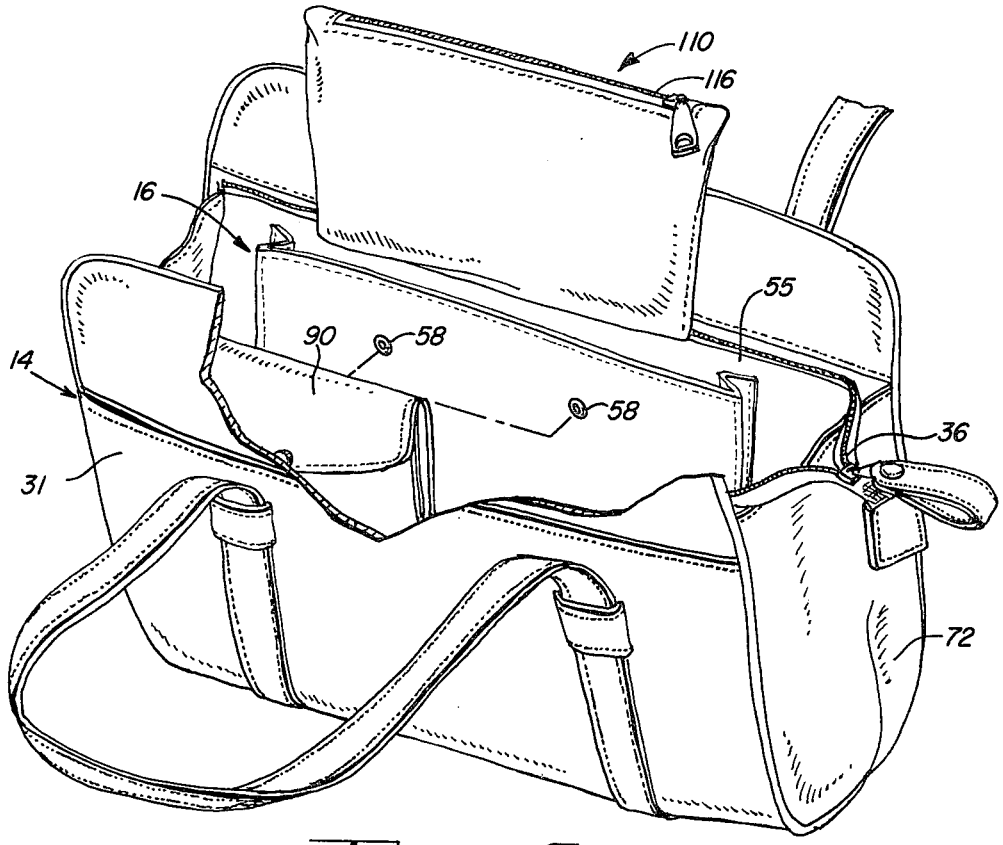
FIG. 8 is a rear perspective of the handbag shown in FIG. 2 illustrating the positioning of various components within the bag.

Referring to FIGS. 2, 7 and 8, another handbag of the system 10 is illustrated. Handbag 14 is constructed in a manner similar to handbag 12 and has a front panel 30 and rear panel 31 joined at side panels 32 forming central compartment 35 accessible through closure zipper 36. An appropriate decorative emblem 34 may be secured to the front panel or to the handbag flap 35.

Compartment 33 on front panel 30 is provided for receipt of various personal items. The inside of the compartment 33 carries adjacent pockets 41, 42 and 47 which are sized in dimension to receive notebooks 62, address books 63 and writing instrument 64, respectively.

As best seen in FIG. 2, pocket 43 is secured along the side edges and bottom to the interior of rear panel 31. This pocket provides a compartment for the receipt of wallet 80 for organization of credit cards, snapshots, checkbook and the like as has been explained.

Snap fastener portions 53 and 54 are secured at opposite sides of the main compartment for receipt of snap-in key retainers 120 and 121. Similarly, a compartment 55 is formed on the interior side of the front panel 30 for receipt of zippered cosmetic pouch 110. The exterior of this compartment carries snap fastener members 58 cooperable with a snap fastener member 97 on coin purse 90 so the coin purse can be easily secured in place in the compartment 35.

With the handbag system of the present invention handbags 12 and 14 are of different exterior styles depending on the personal preference of the user. While the internal compartments may vary in arrangement, the compartmentalization provides for the receipt of common items such as the wallet 80, notebooks, 62, 63, key retainers 120, 121, cosmetic case 110 and coin purse 90. Preferably these components are selected in a color compatible with the handbags and the interior lining of 12 and 14.

It will be seen that the present invention provides a unique and novel handbag system which provides convenient compartments and receptacles for the organized storage of all types of paraphernalia and accessories handbag users require. Further, the handbag components or accessories may be conveniently transferred from one handbag to the other without the necessity of having to physically remove the items from the various storage compartments and receptacles and place them in similar components in another handbag. For example, if the user has placed the components and stored items in handbag 12 and wishes to instead use handbag 14 to more completely coordinate with the style of dress or occasion, the wallet, cosmetic case and address book and memo pad can be removed from the respective compartments in handbag 12 and inserted in the comparable compartments in handbag 14. Similarly, snap-in coin purse 90 can be disengaged and snapped in the appropriate fastener 95 in the interior of handbag 14. The key chains can in like manner be transferred and secured at snap fasteners 53 and 54. It is not necessary to remove the items separately from their cases and individually transfer all the cosmetic items. Various items such as credit cards, photographs, glasses, papers, phone number listings and the like remain in an orderly, organized fashion, convenient for use. Thus it is extremely convenient and quick for the user to change handbags to coordinate with a dress ensemble or an occasion.

Figure 4:
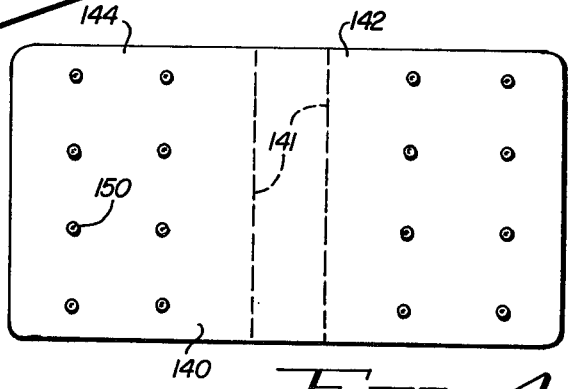
FIG. 4 is a plan view of the interchangeable liner shown in FIG. 3 in a flat position.
Figure 6:
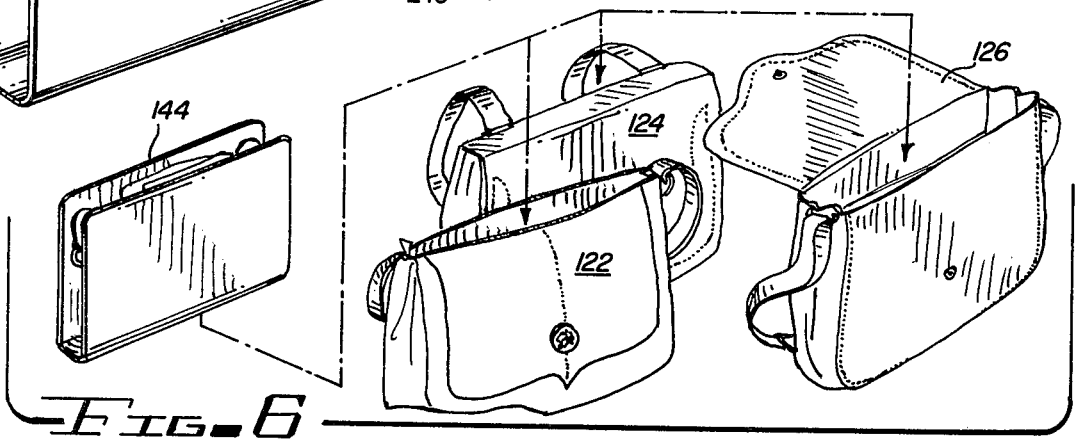
FIG. 6 is a perspective view of the handbag system showing the liner and several handbags.

FIGS. 3, 4 and 6 show an alternate embodiment of the present invention generally designated by the numeral 130. Embodiment 130 again includes a plurality of handbags 122, 124 and 126 which may be of any selected material and styling such as a pouchbag, single or double strap or any other conventional style. As best seen in FIG. 3, handbag 124 which is representative, is constructed having a central compartment 128 formed by front panel 128 and rear panel 132 and side panels 134, cooperatively joined by heat bonding or stitching. The closure flap 136 is hingedly secured to the upper edge of rear panel 132. Strap 135, and cooperating strap, not seen, secured to the rear panel provide means for carrying the handbag.

A removable liner 140 which is generally U-shaped at fold lines 141 having a front panel 142 and rear panel 144 and bottom panel 146. Liner 150 may be made from a suitable rigid material such as a plastic as dimensioned and shaped to be inserted into compartment 128.

As best seen in FIG. 4, the inner surfaces of panels 144 and 142 of liner 140 are each provided with a plurality of spaced-apart snap fastener halves 150. Various components such as the key retainers 160, 161, wallet 170, cosmetic organizer 180 and coin purse 190 all are provided with mating snap fastener halves 171 spaced-apart a distance to align with snap fastener halves 150 so these various accessories can be selectively engaged at the interior of liner 140.

Wallet 170 is constructed generally as has been described with reference to FIG. 1 and is constructed for the orderly containment of credit cards, photographs, checkbooks and the like and further detailed description is not deemed necessary.

Cosmetic organizer 180 is constructed having a U-shaped frame 181 having front panel 184. An elastomeric material 198 is stitched or otherwise secured at 192, to the interior of frame 181 to form a plurality of expandable loops 183 for insertion of various cosmetic items such as lipsticks, mascara and the like. Window 184 in front panel 196 permits the user to view the labels on the various cosmetic items. The rear of frame 181 is provided with snap fastener halves 171 which can be secured at selected mating fastener halves 150 of the liner.

Similarly, coin purse 190 may be detachably secured to the inside of the liner 150. Purse 190 is primarily for the receipt of coins and currency and has front and back panels 201 and 202 respectively. A closure flap 204 which is an extension of rear panel 202, is adapted to overly a portion of the front panel in a closed position and may be engaged at an appropriate fastener 205. A pair of male snap fasteners 171 are secured to the rear of panel 202 of the purse and are cooperable with mating snap fastener members 150 secured to the liner. Thus, coin purse 190 can be engaged to the liner and currency and coins removed and inserted when the pocketbook is in this position. It is also convenient for the user to disengage pocketbook 190 at the snap fastener members and to transfer the pocketbook to the corresponding mating purse 12 in the system. The detachability of the pocketbook provides security as money may be removed from the purse for safe-keeping, in the event the entire handbag is stored or left unattended.

Figure 5:
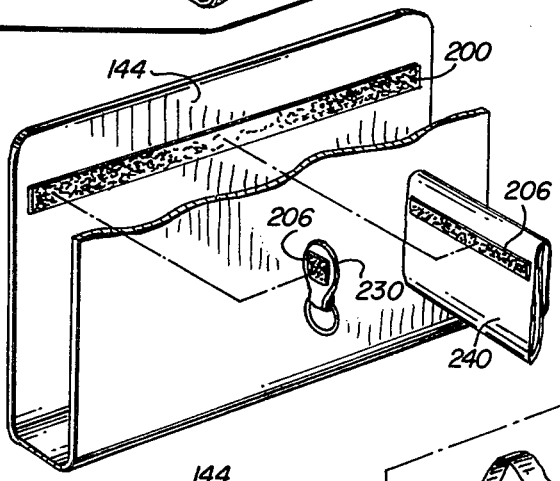
FIG. 5 shows an alternate embodiment of the interchangeable liner.

FIG. 5 illustrates a modification of the embodiment shown in FIGS. 3, 4 and 6 in which the snap fastener members are replaced with loop and pile fastener strips. The liner 144 is again constructed in a U-shape as has been described and is compatible with various handbag designs and sizes. The liner 144 is provided with a plurality of transversely extending loop and pile fastener portions 200 such as the material sold under the trademark "Velcro". Handbag components, illustrated as key retainer 230 and wallet 240, are each provided with a mating loop and pile fastener member 206 on a rear portion of each. The loop and pile fastener members 206 and 200 may be engaged so that the accessory items can be conveniently positioned in the handbag. The use of a loop and pile fastener member gives the user greater flexibility in the positioning of the accessory items within the handbag.

As shown in FIG. 6, the liner can be conveniently transferred to any number of selected handbags 122, 124 and 126 simply by removing the liner and inserting it along with the accessory items into the selected handbag.

Therefore from the foregoing it will be seen the present invention provides a unique and novel handbag system which provides convenient compartments and location for the organized storage of all types of paraphernalia and accessories. With the handbag system, various accessory items can be conveniently and quickly transferred by the user from one handbag to another when it is desired to change a color or style of handbag. Thus the user can with a single set of accessories maintain personal accessories in orderly fashion making it unnecessary to individually transfer items from one bag to another.

Various changes and modifications to the embodiments herein chosen for the purposes of illustration will occur to those skilled in the art. To the extent these changes and modifications do not depart from the spirit and scope of the appended claims, they are intended to be included therein.

Having fully described and disclosed the present invention and several preferred embodiments in clear and concise terms to enable those skilled in the art to understand and practice the same, I claim:

1. A handbag system for the convenient and orderly storage and interchangeability of various accessory items comprising:

(a) at least a first and second handbag each in a different style and/or color, each of said handbags defining at least a main compartment;

(b) a removable liner having a panel with first attachment means associated therewith, said liner being adapted to be selectively interchanged between said handbags and accomodated in said compartment; and (c) a plurality of accessory organizers for the organized retention of various items, said accessory organizers having an appearance compatible with said handbags, each of said accessory organizers having second attachment means cooperable with said first attachment means whereby said accessory items can be selectively secured in said liner for the orderly containment of accessories.

2. The handbag system of claim 1 wherein said accessory organizers include at least a wallet, coin purse and key retainer.

* * * * *